United States Patent [19]

Kemp

[11] Patent Number: 5,062,362

[45] Date of Patent: Nov. 5, 1991

[54] OSCILLATING PRINTING PRESS ROLLER HAVING A PLURALITY OF SEPARATE ANNULAR PISTONS

[75] Inventor: James R. Kemp, Hurst, Tex.

[73] Assignee: Advanced Graphics Technologies, Inc., Grapevine, Tex.

[21] Appl. No.: 651,747

[22] Filed: Feb. 4, 1991

Related U.S. Application Data

[63] Continuation of Ser. No. 255,153, Oct. 7, 1988, abandoned.

[51] Int. Cl.[5] ..... B41F 31/14; B41F 7/26

[52] U.S. Cl. ..... 101/348; 101/148; 101/DIG. 38

[58] Field of Search ..... 101/348, 148, 349, 350, 101/351, DIG. 38, 205–210, 353, 354, 355–362, 367; 74/828, 18.2, 22 A; 91/170 R, 216 R, 216 B, 216 A

[56] References Cited

U.S. PATENT DOCUMENTS

| | | | |
|---|---|---|---|
| 2,300,949 | 11/1942 | Luehrs | 101/367 |
| 2,319,615 | 5/1943 | Luehrs | 101/367 |
| 2,703,050 | 3/1955 | Faeber | 101/348 |
| 3,179,047 | 4/1955 | Ordway | 101/348 |
| 3,983,812 | 10/1976 | Schramm | 101/349 |
| 4,295,423 | 10/1981 | Johne et al. | 101/349 |
| 4,777,877 | 10/1988 | Lemaster | 101/426 |

FOREIGN PATENT DOCUMENTS

| | | | |
|---|---|---|---|
| 93150 | 6/1982 | Japan | 101/348 |
| 1331849 | 9/1973 | United Kingdom | 101/349 |

*Primary Examiner*—J. Reed Fisher

*Attorney, Agent, or Firm*—Juettner Pyle & Lloyd

[57] ABSTRACT

A pneumatic axially oscillated, frictionally rotated roller is disclosed and may be used in the ink or damping systems of a printing press. The roller features an internal air piston-cylinder construction that causes the axial motion but permits the roller to freely rotate. Further, several air cylinders can be stacked on each side of the roller to permit even a small diameter roller to be pneumatically oscillated. The roller, when used as an ink form roller, may be operated to oscillate in synchronization with an adjacent oscillating, vibrating roller to continually diagonally redistribute the ink so as to eliminate or minimize "ghosting". The foregoing is accomplished by controlling the oscillation of the form roller to move axially in a direction opposite of that of the vibrating roller. The lengths of the strokes of the two rollers may differ or be the same. The length of axial movement or stroke of the form roller can be varied, while maintaining synchronization by varying the speed of the axial motion, a slower speed yielding a shorter stroke and a higher speed yielding a longer stroke for a given half cycle.

25 Claims, 8 Drawing Sheets

OSCILLATING PRINTING PRESS ROLLER HAVING A PLURALITY OF SEPARATE ANNULAR PISTONS

This is a continuation of copending applications Ser. No. 07/255,153 filed 10/7/88 now abandoned.

This invention relates to printing press rollers and more particularly to oscillated rollers for use in inking and dampening systems of printing presses.

BRIEF DESCRIPTION OF THE PRIOR ART

It has been known to use an axial oscillating motion on rollers in the inking and dampening systems of lithographic presses for vibrating rollers (sometimes also called distributing or transfer rollers) somewhere between the ink or fluid dampening fluid source and the form rollers which ride on the plate cylinder or roller. Generally, these vibrating or transfer rollers are rotatably press driven, and made to mechanically axially oscillate.

Further, oscillating form rollers have been developed which are frictionally axially driven by the oscillating motion of an adjacent transfer or vibrating roller. Also, pneumatically oscillated and mechanically rotated vibrating rollers have been previously developed. A fluid motor powered oscillating roller for the fluids in ink and dampening systems is known. It is also known to mechanically axially oscillate a roller. It is also known to use a mechanically rotated and mechanically axially oscillated form roller in conjunction with an oscillating vibrating roller wherein both rollers are oscillated at different frequencies.

However, the prior art rollers, while solving some of the problems of inking or dampening fluid distribution, often created other problems or were not a complete solution to the fluid distribution problem. For example, with frictionally axially driven oscillating form rollers, when the form roller is being dragged in one direction by the adjacent axially moving vibrating roller, there is usually a period of time when the two rollers move axially essentially in unison so that little or no axial ink shearing action takes place in the nip of these two rollers. Consequently, the new ink being supplied to the form roller by the vibrating roller is only radially transferred and not axially redistributed on the form roll, and the likelihood of "ghosting" occurring increases.

In most presses, where the form roller was originally intended to be non-oscillating, and an oscillating form roller is being retrofitted, due to press construction, the retrofitted form roller does not move the full axial distance of the vibrating roller. Consequently, there is another period when the form roller's axially oscillating motion is intentionally stopped to prevent the form roller from moving into contact with the bearers on the plate cylinder or other parts of the press, such as its frame or bearing holders, while the vibrating roller continues to oscillate to its full axial travel. This type of intermittent axial movement of the form roll is widespread as most frictionally axially driven prior art oscillating form rollers have been provided with stop collars to prevent undue travel and contact of the form roller with such other parts of the press. When operated in this manner, there is good transfer from the vibrating roller to the form roller when the axial shearing action occurs, but the transfer from the form roller to the plate cylinder/roller is less than ideal when these two rollers are now merely rotating and no diagonal transfer to the plate cylinder takes place as the form roller is stopped by a collar from axially oscillating. As these two different modes of operation occur during each axial stroke making up a full cycle of the form roller, each mode has its own effect on print quality. Thus, it is difficult to obtain identical print quality during these two different modes of the full cycle as the plate is being supplied with different quantities of ink by the form roller, which, in turn, is receiving different quantities of ink from the transfer or vibrating roller.

While numerous attempts have been made to mechanically oscillate rollers to achieve more uniformity, mechanical drives are complicated and expensive. For this reason most form rollers on presses have not been mechanically axially oscillated. Additionally, the form rolls are generally not fixed in a single location, but are mounted from swing hangers, which are in turn biased and movable toward both the plate cylinder and adjacent vibrating roller. This required flexibility imposes additional complexity in trying to mechanically oscillate such rollers. While it might be possible to design a new press for a mechanically axially oscillated form roller, such would be costly to build and operate. While it might be challenging to design a successful mechanical oscillating mechanism for a new press, it would be even more challenging to design one for an existing press. For this reason, many of the retrofitted oscillated form rollers have only been axially oscillated by friction from the oscillating motion of an adjacent vibrating roller. Further, as form rollers in most presses were not mechanically driven, the press frames adjacent to the form rollers are usually solid, and such construction prevents retrofitting of a fluid drive extending outside the press frame.

While pneumatics have been utilized within the roller itself to provide oscillating motions for vibrating or transfer rollers, the were suited for small presses and were not adaptable to larger width presses requiring long, small diameter size rollers frequently found on presses in the ink and dampening systems. Also, some prior art pneumatic rollers have used a fixed shaft and the rotating roller body or core, itself, as an air cylinder. Consequently, as the cylinder rotated, sealing thereof was difficult and/or caused the seals between the fixed and rotating portions to be forced by air pressure against the portions and to act as brakes, making the roller more difficult to rotate, shortening seal life and resulting in increased maintenance and downtime. Another disadvantage of the prior pneumatic oscillating vibrating roller construction is that it is generally limited to relatively short width presses, such as small forms presses, due to roller deflection at the center. A pneumatic roller with a rotating cone used as an air cylinder, having a piston fixed to a center shaft would not be suitable for wide presses, say of a width of greater than 36 inches. This limitation flows from the fact that as such a pneumatic roller is pressed against an adjacent roller, due to its construction, the center shaft is deflected away from the adjacent roller and, in turn, because of the abutting center portion therein, the center of the roller is also deflected away from the adjacent roller. Thus, the harder the roller's end journals are forced toward the adjacent roller, the more it aggravates the problem and results in more, and not less, deflection at the center and less uniform loading of the vibrating roller against the adjacent roll. With a roller length of 36 inches or more, a center deflection problem becomes critical and is even greater in longer rollers.

This non-uniform roller loading, of course, tends to cause ink or dampening fluid variation across the roller, resulting in print quality variations across the roller.

While attempts have been made to have both a form roller and vibrating roller oscillate, these prior art devices have used complicated mechanical drives on both rollers which cannot be easily retrofitted to an existing press originally fitted with a non-oscillating form roller. Further, there has been no way to optimize the wiping action of the rollers as: the axial motion during oscillation of the form roller was for only part of the time or not synchronized with that of the vibrating roller; there was no relative axial motion between the form roller and the vibrating roller; or the wiping action between the form roller and vibrating roller was not uniform or maximized, as when the form and oscillating rollers oscillated at different frequencies. Such a device introduces yet another variable in ink and/or dampening fluid distribution. That is to say for different portions of a complete cycle, different degrees of shearing action would take place between the two rollers oscillated at different frequencies, which will cause ink delivery, and consequently printing quality, to vary.

BRIEF SUMMARY OF THE INVENTION

The oscillating roller of the present invention can be used as a form roller or in another roller position, such as a vibrating roller in the dampening or inking system of a press. The press can be of any type that has an ink train or dampening train and includes lithographic offset and flexo offset presses. In the preferred form, the oscillating roller of the present invention comprises an axially extending roller shaft that is adapted to be mounted to the press frame. This roller shaft can be either a dead shaft, i.e., non-rotating, or a live shaft, i.e., rotating. To the roller shaft is fitted a piston element which is axially located on the shaft. The roller has a covering, generally of any suitable material used in ink or dampening trains, such as metal (chrome plated), rubber or plastic compounds, or ceramic materials. The piston cooperates with a cylinder element or structure and forms therewith an axially variable volume. The roller cover and cylinder structure are arranged in a manner that expansion or contraction of the variable volume causes the roller covering to axially move or oscillate. Of course, a reverse construction can be used, that is with the cylinder structure axially located on the shaft and the piston moving the roller covering. The cylinder structure and piston are located within the roller between the roller shaft and roller covering in a manner not to interfere with the press frame, to retard roller rotation, or to cause roller deflection. In the dead shaft version, the piston and cylinder structure are independent of the roller shaft and the roller covering and its core. In the live shaft version, as rotational motion is accommodated by bearings on the ends of the roller shaft that mount the shaft to the press frame, the piston and cylinder structure can utilize the outer surface of the shaft and the inner surface of the roller covering or its backup core to form the variable volume. In order to minimize or eliminate roller deflection problems due to shaft journal loading against an adjacent roller, unlike in the prior art, the piston and cylinder structure is located very close to the ends of the roller and not at or near its center. Thus, the roller of the present invention is particularly suited to long rollers, say for 36 inch paper or press widths or larger, and to slender rollers (a high ratio of length to diameter).

In order to develop adequate oscillating force, particularly in small diameter rollers, the piston and cylinder structure of the roller can be stacked double, triple or as many as necessary to develop sufficient force to oscillate the roller against any forces resisting oscillation, such as from an adjacent roller oscillating in the opposite direction. Of course, the stacked piston-cylinder structure is spaced from the roller body or core, kept to the ends of the roller, and does not extend to the center to minimize deflection problems.

To further minimize deflection problems, and reduce manufacturing costs, the roller shaft, piston and cylinder structure does not use close tolerances, but are made to freely fit one another. Where it is necessary to provide a tight seal or to prevent rotation of parts, "O" rings are used instead of heretofore tight pressed fits.

The oscillating roller of the present invention can be used in conjunction with another, adjacent oscillating roller, and in such a case, the roller of the present invention can be oscillated at the same cyclic rate or frequency, either in the same or opposite direction of the adjacent oscillating roller with the same, greater or lesser stroke If each print made is to be of the same consistent high quality, it is necessary that the plate be dampened and inked in exactly and precisely the same way. To maintain such consistency, delivery of ink and dampening fluids must be without variance.

To achieve the consistency for maximum redistribution of ink and/or dampening fluids, and also to reduce "ghosting", the oscillating roller of the present invention, when used in the form position, can be used with an adjacent vibrating or distributing roller so that these two rollers oscillate at the same frequency but move axially in different directions. Such construction and operation provides for consistent axial shearing between these two rollers and between the form roller and the plate cylinder to insure that the exact and precise relationship are repeated each time the plate is inked and/or moistened. Further, the resultant transfer of fluid, be it ink or dampening moisture, between the vibrating roller and form roller and, also, between the form roller and plate cylinder is in a desirable diagonal pattern. That is the relative axial motions and rotational motions of the two respectively adjacent rollers always forms a diagonal pattern.

The oscillation of the rollers of the present invention is controlled by a control means which senses the oscillation of the adjacent roller, such as the change of direction of the axial motion, and controls the admission and venting or exiting of pressurized fluid or compressed air from the piston-cylinder structure to cause the roller of the present invention to oscillate, preferably, in the above manner. The control system gives the roller of the present invention a variable length stroke, and can axially move the roller of the present invention at the same speed as the adjacent roller, a slower speed than the adjacent roller, or at a faster speed with a dwell time, if desired, that can be varied. Thus, the wiping action between the oscillating roller of the present invention and the adjacent oscillating roller, and with the plate cylinder, can be optimized. The motion of the oscillating roller of the present invention is achieved by supplying compressed air at a regulated high air pressure to the piston-cylinder structure on one side of the roller and exhausting or venting the piston-cylinder structure on the opposite side of the roller through a variable area orifice. Changing the size of the exhaust orifice will change the roller speed. Of course, a higher or lower supply pressure will also change the oscillation speed. Adjustment of the supply pressure and/or venting can also be used to provide, eliminate, or adjust a dwell time. The length of the oscillation or stroke is determined by its speed. For a long stroke a high speed is used, and for a short stroke a low speed is used.

It is an object of the oscillating roller of the present invention to provide a pneumatic mechanism which can be easily installed on a printing press to eliminate "ghosting".

Another object of the oscillating roller of the present invention is to provide an air piston-cylinder construction which causes an axial motion without restricting rotational motion Yet another object of the oscillating roller and method of the present invention is to provide an air piston-cylinder construction spaced from the outside of the roller body or core and/or confined to the ends of the roller to eliminate and minimize roller deflection.

Still another object of the oscillation roller of the present invention is to provide a construction which permits more than one piston-cylinder structure to be provided on each side of the roller, so that even small diameter rollers can develop sufficient force to provide the desired oscillation.

Yet another object of the oscillating roller and method of the present invention is to provide a roller that can be used in conjunction with another adjacent oscillating roller so that both rollers are synchronized to operate at the same cyclic rate or frequency, moving in the same or opposite directions, with speeds and/or strokes to provide optimum wiping action for the printing job at hand.

Yet a further object of the oscillating roller and method of the present invention is to provide a form roller which can be used in conjunction with an adjacent vibrating roller so that both rollers are synchronized to operate at the same cyclic rate or frequency, moving in axially opposite directions to maximize fluid distribution for eliminating "ghosting".

Still another object of the present invention is to provide a structure for pneumatically oscillating a roller in the ink or dampening system of a press.

A further object of the present invention is to provide an oscillating roller structure particularly suited to retrofitting into a press in place of a non-oscillating roller.

These and other objects and advantages of the present invention will become apparent from the accompanying figures of the drawings and the following written description.

BRIEF DESCRIPTION OF THE DRAWINGS

Referring to FIG. 1, one type printing press on which the oscillating roller of the present invention can be used, is illustrated. While the press shown is a lithographic or offset press having both an ink train and a dampening fluid train, the press could be of the type wherein these two systems, ink and dampening, merge or of a different type press, such as gravure or flexopress. In the two side press shown in FIG. 1, the web 9 runs through between two offset or blanket cylinders or rollers 10, each of which run against its own plate cylinder or roller 11. Each plate cylinder is fed ink fluid from a fountain 12 and dampening fluid from a tray 13 by roller trains which include rollers 14, which in some presses may be ductors, distribution rollers 15, axially oscillating vibrating rollers 17 and form rollers 18 which ride against the plate cylinder. In addition, rider rollers 20 are shown on the form rollers 18. The oscillating roller of the present invention could be utilized for any of the rollers in the positions indicated by the reference numerals 17, 18, and/or 20.

Referring to FIG. 2, a first embodiment of oscillating roller 30 of the present invention is illustrated. The figure actually shows only one end (the left) of roller 30, the other end of the roller being of generally similar construction, and what differences there are will be verbally described or may be observed in FIG. 6.

Figure 1:
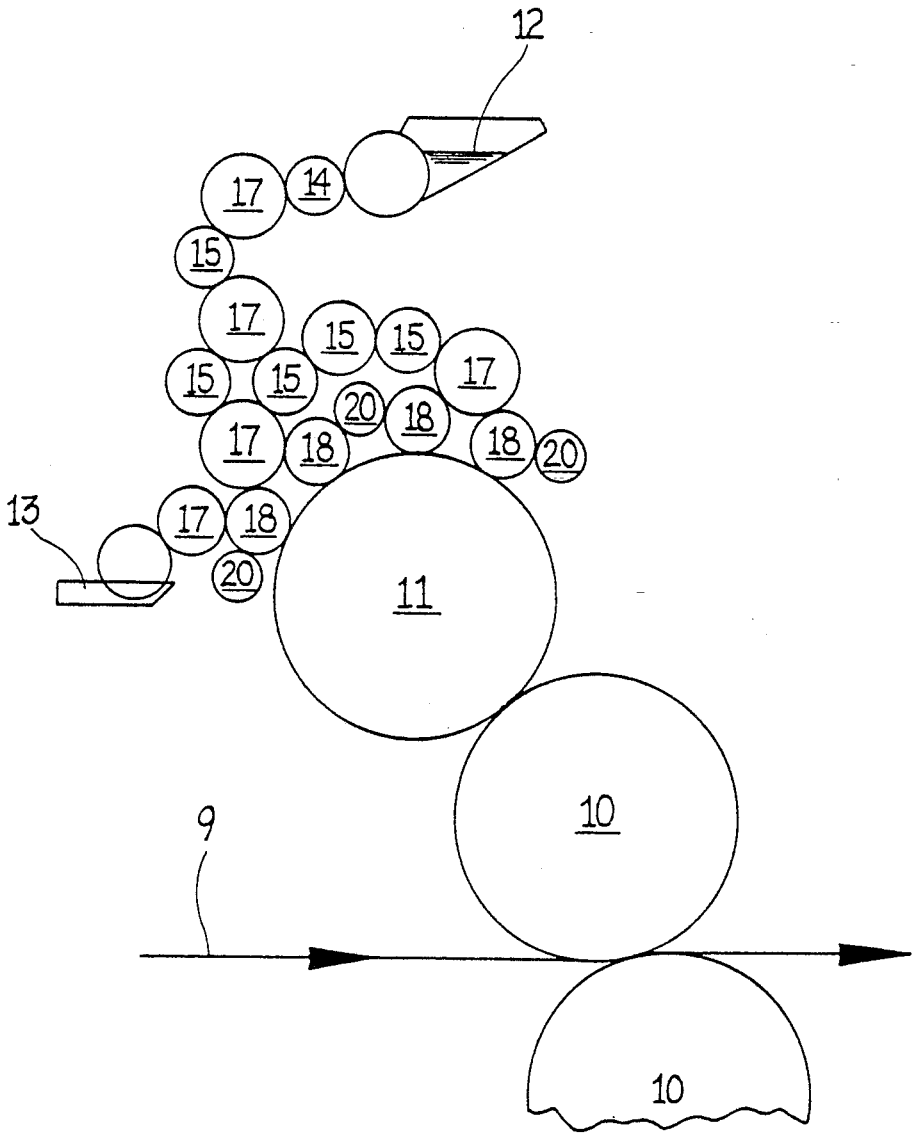
FIG. 1 is a cross-sectional view of one type of press in which the oscillating roller of the present invention may be used.

As shown, a roller 30 is mounted in a press hanger or frame 32, only partially shown. For purposes of a convenient reference, it will be assumed that this roller is used in position numbered 20 in FIG. 1. In this instance, the roller 30 was retrofitted to replace live shaft roller, and that is why the press frame 32 has a bearing cavity 34, which, in this instance, to make the conversion is fitted with a dummy bearing 36. The dummy bearing 36 is clamped or located in the press frame 32 by conventional means (not shown) to prevent its rotation. The reduced diameter pilot end 38 of a roller shaft 40 extends into the dummy bearing and is retained by a roll pin 42. The other end (not shown) of shaft 40 is similarly mounted to the press frame. Roller shaft 40 is dead, i.e., it does not turn.

Figure 2:
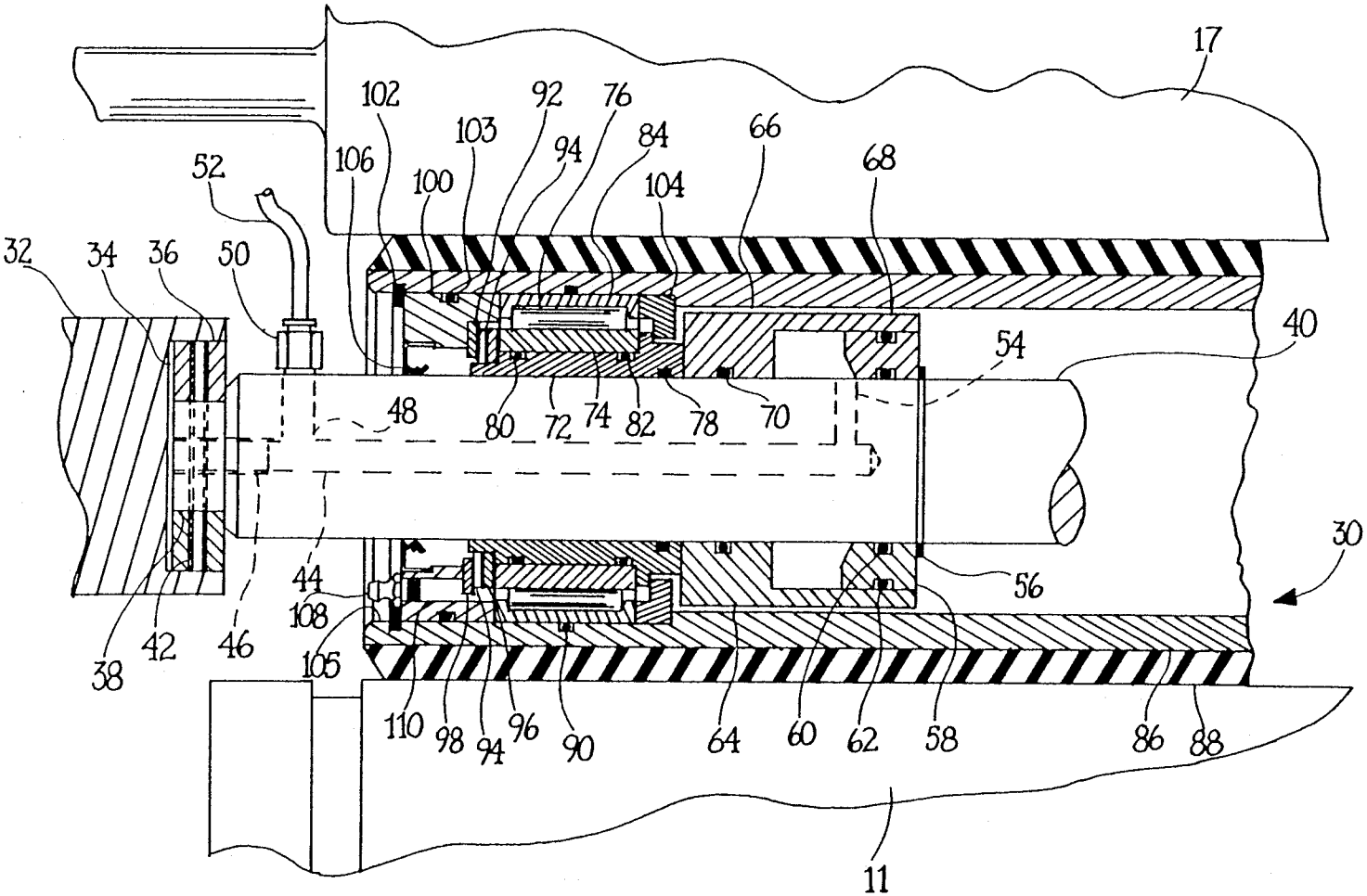
FIG. 2 is a cross-sectional view of one end of a first embodiment of an oscillating roller of the present invention utilizing a dead or non-rotating shaft.

As can be seen from FIG. 2, the roller shaft is enlarged from the pilot end 38 to a larger diameter. The shaft 40 extends completely across the press to the hanger or frame on the opposite side. The diameter of the roller shaft is increased to better resist the bending loads imposed on the shaft by the contact with one or more adjacent rollers (See FIG. 1).

In order to supply pressurized fluid or compressed air to the working mechanism of the oscillating roller of the present invention, the center of the roller shaft 40 is drilled partially through, as indicated at 44. While in some instances the outer end of opening 44 could be utilized to connect with an air supply/vent, in this instance because of the solid press frame 32, such is not possible, and the outer end of 44 is closed, as by a pipe plug 46. In order to bring and vent pressurized fluid to and from the passage 44, a short radial passage 48 is provided in the shaft 40 and fitted with an appropriate fitting 50 and a hose or tube 52 to connect it to the control system, suitable control systems being shown in FIGS. 6 or 7. Similarly, a radial passage 54 is provided to supply or vent air from the passage 44, it being understood that passage 54 is in fluid communication with the air supplied or vented through hose 52.

The structure of the oscillating roller of the present invention causing and accommodating the sliding or axial oscillating motion will now be described. The shaft 40, several inches from each end, is grooved for circle clip 56, this groove being located inward of the radial passage 54. Slidably fitting on the shaft is an annular piston member 58 which abuts against the outer side of the circle clip 56. The piston 58 is grooved on its inner and outer diameters to receive sealing "O" rings 60 and 62 to seal the piston 58 to the adjacent surfaces. An annular cylinder member 64 also slides on the roller shaft 40 and has a cylinder head portion 66 and a connected cylinder wall portion 68 into which the piston 58 can slide. The inner surface of the cylinder head portion 66, adjacent to the roller shaft, is also grooved to accept a sealing "O" ring 70. It should be understood that the admission of air into the axial variable volume space defined between the piston member 58 and cylinder member 64 will force the piston member to the right, abutting the circle ring 56 and causing the cylinder member 64 to move to the left. Of course, admission of air to the axial variable volume chamber between the piston and cylinder members (not shown) on the other side of the roller will cause that cylinder member to move to the right. This axial oscillation to the right or left can be caused by pressurization and/or venting of the variable volume chambers on the right or left side of the roller.

The axial motion of the cylinder members is transferred to an annular sleeve 72, made of oil impregnated bronze, also slidable on the roller shaft 40. As is shown in FIG. 2, the right hand end of this sleeve abuts the left end of the cylinder member 64 for this purpose. The axial sleeve carries, in this instance, an inner race 74 for a roller bearing 76. Both the inner and outer surfaces of the annular sleeve are grooved to accommodate "O" rings 78, 80 and 82 which provide a secure fit for the sleeve on the shaft, and prevent any tendency for the inner race 74 to rotate on the annular sleeve, and the annular sleeve to rotate on the shaft 40. Thus, the annular sleeve 72 and inner race 74 are only subject to axial motion and not rotational motion.

The roller bearing 76 has an outer race 84 which engages with the roller body or core 86 carrying the roller covering 88. Thus, the roller covering 88 and core 86 are rotatably mounted by the roller bearing 76 for free rotation. Again, the core 86 is grooved to accommodate an "O" ring 90 which makes for a tight fit with the outer race 84 without the need for extremely close tolerances and also causes the outer race and core to rotate together, and both freely rotate with respect to the roller shaft 40.

As the roller bearing shown will not take axial thrust, a thrust bearing 92, consisting of radial rollers 94, an inner race 96, and an outer race 98 abuts the annular sleeve 72. The outer end of the annular sleeve is stepped, in this instance, to accommodate the inner race 96. The outer race 98 is carried on an end ring 100, which is held in place by an outer circle ring 102 located in a groove on the end of the roller core 86. Again, an "O" ring 103 is provided in the end ring 100 to prevent relative rotation between the end ring 100 and the roller core 86.

To locate the outer race 98 in the core 86, the end ring 100 stacks against the outer race 84 of the roller bearing 76 and an "L" shaped cross-section keeper 104, all in an enlarged diameter 105, formed in the outer end of the core 86. The keeper 104 is provided to insure that the annular sleeve 72 and inner race 74 are captured and that the thrust bearing rollers 94 and inner race 96 remain supported at all times on the annular sleeve 72. A seal 106 is provided between the end ring 100 and the shaft 40 to close the roller and to keep the lubrication for the thrust bearing 92 and roller bearing 76 in place. A grease fitting 108 and grease passage 110 can be provided in the end ring 100 to lubricate the roller bearing 76 and thrust bearing 92.

With the foregoing construction, the axial motion is entirely separated from the rotational motion, and no seal subjected to air pressure is also subject to rotational motion. Thus, there is no tendency for the rotational seals to act as a brake or provide added resistance to rotation, as was the case in the prior art.

Figure 6:
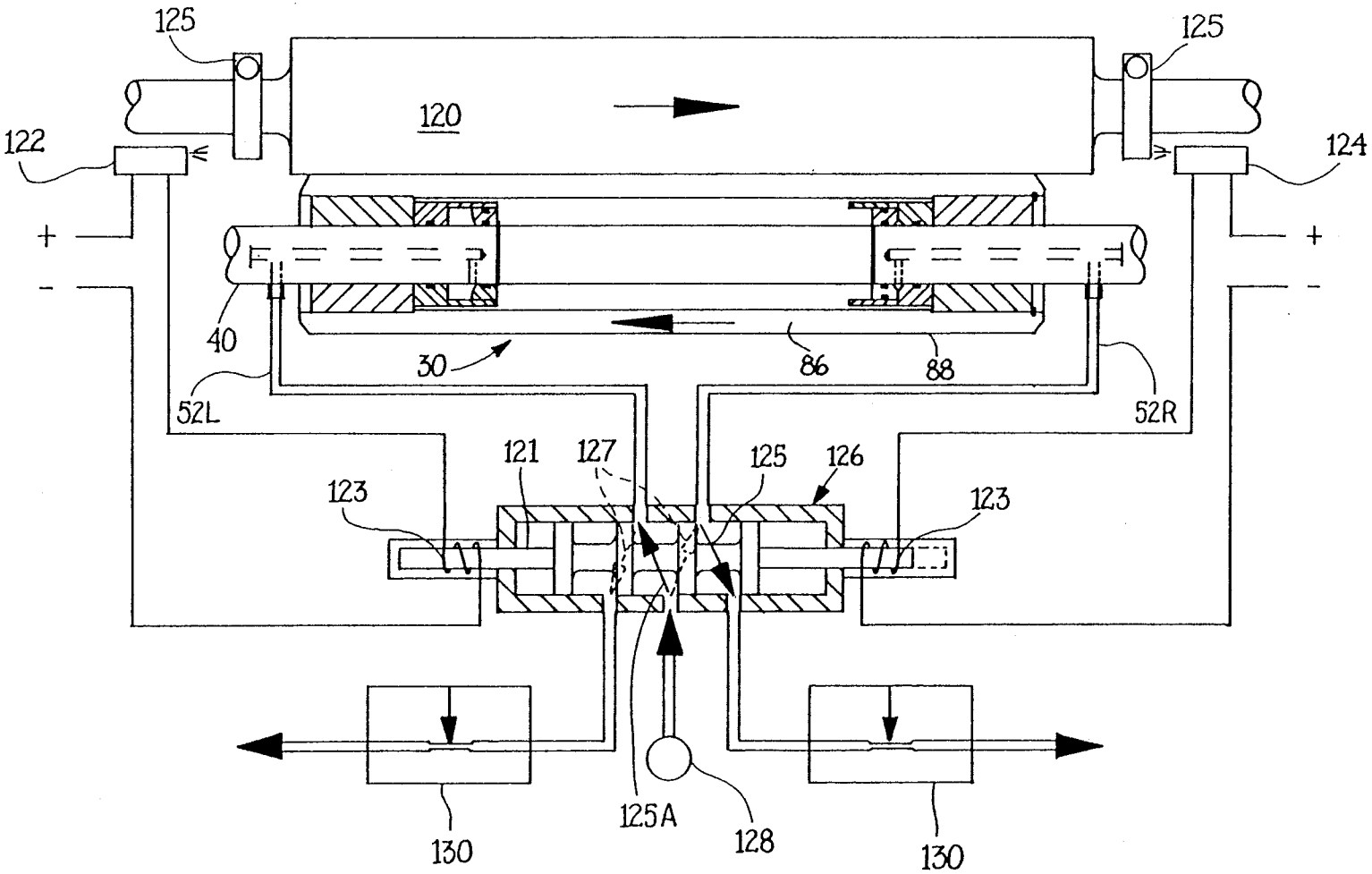
FIG. 6 is a schematic view of one form of control system for the oscillating roller of the present invention.
Figure 7:
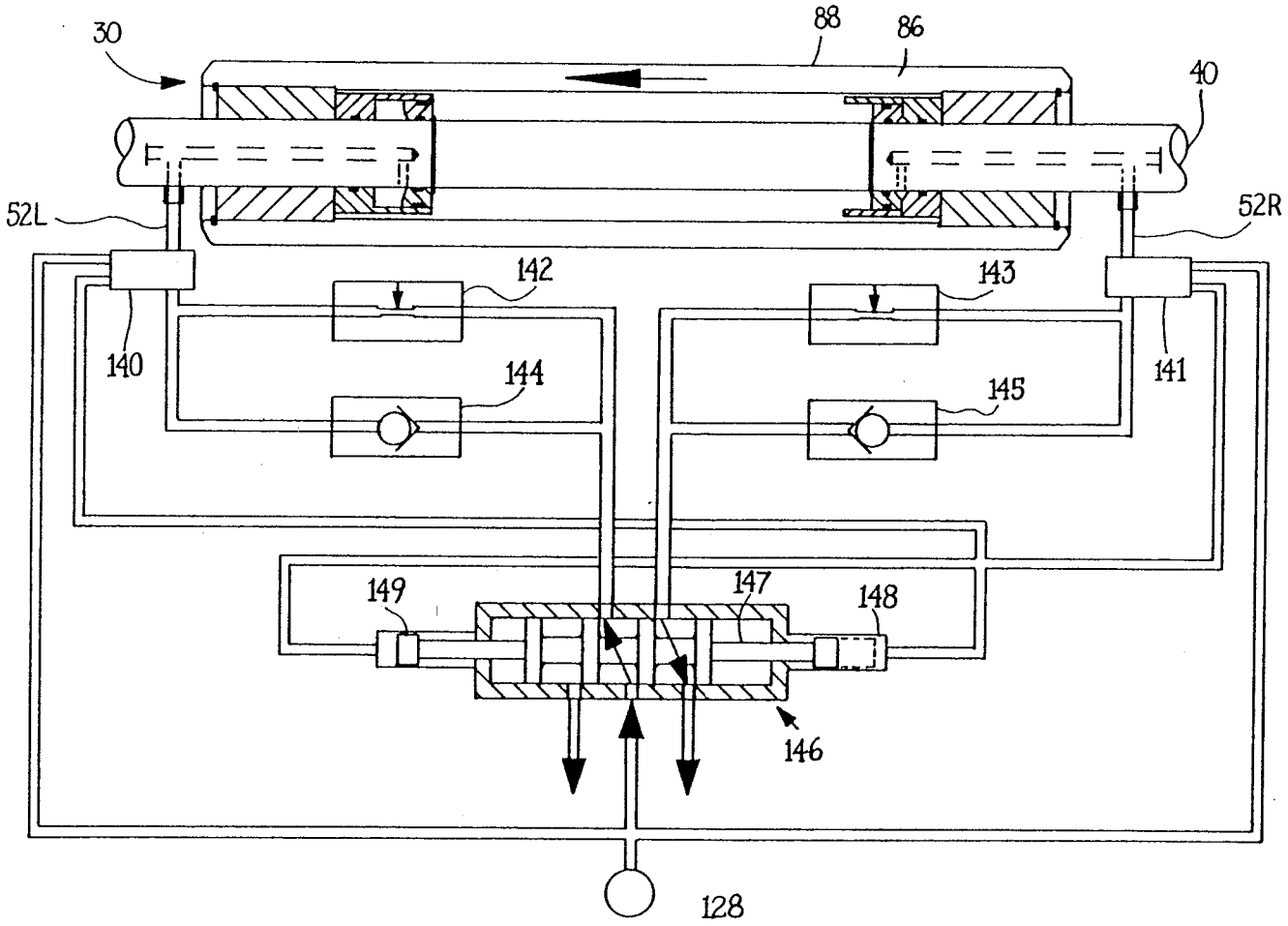
FIG. 7 is a schematic view of a second form of control system for the oscillating roller of the present invention.

Preferably, the axial oscillation of the roller of the present invention may be controlled by the control system shown in FIGS. 6 or 7. First, the system of FIG. 6 will be described. In this figure, the roller 30 of the present invention is assumed to be in a form position (See reference numerals 18 of FIG. 1) in contact with the plate cylinder (not shown in FIG. 6) and a vibrating roller 120 which is mechanically axially oscillated by the press drive. As is shown, the oscillation of the adjacent oscillating vibrator roller 120 is sensed by means such as proximity switches 122 or 124 (such as cylindrical AC or DC type, made by Furnas) sensing the roller's change of direction at the end of its axial motion (trigger points). Of course, other type of devices than proximity switches 122 and 124 could be used, such as microswitches or pneumatic logic devices, or the timing signal could be taken from somewhere on the press drive or vibrating roller drive. If desired, instead of sensing the roller 120, itself, one or the other of two adjustable collars 125, fitted to the opposite ends of the shaft of roller 120 could be sensed. The use of adjustable collars permit these trigger point to be easily changed. Likewise, the proximity switch locations could be changed to adjust the trigger points. When the end of the axial travel of the roller 120 or collar 125 (providing the trigger point) is sensed, a signal is sent to a solenoid operated 4-way directional control valve 126 (such as of a type similar to a Directair 2 valves, direct pipe port 4-way double solenoid spool valve made by the Schrader Bellows division of Parker Hannifin), causing that valve to pressurize the axial variable volume on one side of the roller 30 and to vent the axial variable volume chamber on the other side of the roller 30.

As is shown, a slidable body 121 in the valve 126 is moved by one or the other of the solenoid's coils 123 so that the one variable volume is pressurized and the other is vented. As shown in FIG. 6, the left side variable volume is being pressurized while the right is being vented, as indicated by the solid arrows 125, so that the roller 30 and its covering 86 will move to the left until the piston and cylinder head of the right variable volume contact each other and limit further movement or there is a subsequent reversal of the direction of the roller 120.

When the right end of the roller 120 reaches its rightmost end of travel, it triggers the proximity switch 124, which, in turn, will energize and cause the right side coil 123 to move the valve body 121 from its shown leftmost position, to the right, as partially shown in dotted lines at the right end of body 121, so that the right variable volume is pressurized and the left vented, as indicated by the arrows 127 in dotted lines. When the foregoing occurs, the core 86 and covering 88 of the roller 30 begins to move and will continue to move to the right until the piston and cylinder head of the left variable volume contact or there is a subsequent change of direction of the roller 120.

During this time the roller 120 was moving to the left, and upon reaching the leftmost end of its stroke, it triggers the switch 122 and then starts to return to the right. The triggering of switch 122 energizes the left coil 123 to, again, reverse the valve body 121, to cause the core 86 and covering 88 of the roller 30 to again move left. The above operation is repeated in succession as long as it is desired to oscillate the roller 30. Thus, the control system of FIG. 6 causes the core 86 and covering 88 of the oscillating roller 30 to change direction substantially at the same time the adjacent oscillating vibrating roller 120 changes direction.

Now while the oscillating roller of the present invention, as described above, moved in the opposite direction of the adjacent oscillating roller, if desired, it could also move in the same direction as the adjacent oscillating roller, depending upon which sides of the oscillating roller of the present invention are being pressurized and vented. The speed of the oscillation of the roller of the present invention can be made greater than, less than, or equal to the speed of that of the adjacent oscillating vibrating roller. Of course, if the speed is greater, there may be a dwell period at the ends of the strokes. Likewise, the length of the oscillation can also be controlled. For example, if the roller of the present invention were moved slowly, such that a full stroke was not completed before a change of direction occurred, it would have a shorter oscillation than were it moving faster, assuming the axial speed of the adjacent oscillating roller (triggering the oscillation of the roller of the present invention) being kept constant. The axial speed of the oscillating roller of the present invention can be increased by increasing the supply pressure via a conventional regulator 128 and/or by decreasing the restriction of valves 130 inhibiting venting. The speed, of course, could be decreased by decreasing the supply pressure, and/or by increasing the restriction (reducing the flow area) of valves 130.

Also, if desired, the roller 30 can be prevented from oscillating and be simply biased toward one side or other of the press. For example, one of the solenoid coils 123 could be kept energized to keep the valve body in the position shown in FIG. 6 so that the roller covering 88 would be biased to the left. Alternatively, such biasing could be achieved pneumatically as by supplying pressure to only the left side variable volume. Another alternative would be to use a different type valve, instead of valve 126, which also provides a centered position. In any event, whether biased to either side or centered, there is no problem as the roller 30 of the present invention never leaves the vibrating roller 120 as the latter is longer, and never leaves the edges of the forms on the plate cylinder, as the forms are inside the edges of the covering 88 of the roller 30.

Referring to FIG. 7, a second form of control system is shown, and unlike the system shown in FIG. 6 which synchronized oscillations to an adjacent roller, the system of FIG. 7 is self oscillating. A system like that shown in FIG. 7 is ideal where there is no need or desire to synchronize oscillations of the roller of the present invention to that of another roller, such as would be the case for a roller shown in the position indicated by the numeral 15 in FIG. 1. Also, the system of FIG. 7 could be used to self oscillate one roller and a system of FIG. 6 used to oscillate an adjacent roller, such as a form roller and vibrating roller for the dampening or ink system. Such arrangement would be particularly useful in retrofitting two adjacent oscillating rollers to a press which had non-oscillating rollers.

As is apparent from FIG. 6, in this instance the roller 30 has the same right and left air supply/vent lines 52L and 52R for the right and left variable volumes in the end of the roller. These air lines are connected to two function valves 140 and 141 (such as model #7818-5420 made under the trade name Legris) which detect the presence or absence of pressure in the lines 52L and 52R, respectively, to self oscillate the roller. As is shown, after leaving the function valve, each of the lines 52L and 52R bifurcate into a first part having a variable area restriction valve 142 or 143 (such as the valve 130 shown in FIG. 6) and a second part with a one way valve 144 or 145, only permitting flow when its ball is off its seat in a direction to its respective variable volume. For convenience, the one-way valve 142 or 143 and the restriction valve 144 or 145 can both be incorporated in a single body, such as in a SC1 sold by Humphrey. The lines then join again and enter a four way valve 146 having a slidable partitioned valve body 147, similar to that of valve 126 with valve body 121, but different in that the valve body is air operated, instead of electrically operated. Such a valve 146 is sold as a 4PP valve by Humphrey. As is shown, each end of the valve body 147 is provided with a piston-cylinder construction 148 and 149 (such as model 34A made by Humphrey, air operator for valve 146) which, in turn, is connected back to one or the other of the two function valves. The function valves, 140 and 141 and the 4 way valve 146 are all connected to a source of high pressure, such as the pressure regulator 128.

With the control system, as shown in the position in FIG. 7, high air pressure is provided from the regulator to the 4 way valve, as indicated by the left arrow, to the left variable volume between the left piston cylinder of the roller and to both function valves 140 and 141. As the left line 52L is pressurized, the left function valve 140 is, due to its constriction, closed to inhibit passage of pressurized air through the lines from the regulator to the right side piston cylinder 149 on the valve body 147. The right piston cylinder in the roller is, however, being vented through the function valve 141, variable area restriction valve 143 and 4 way valve 146, as indicated by the right arrow. As the pressure in the right variable volume drops, the right function valve 141, due to its construction, opens to permit flow from the regulator through the right function valve to the piston cylinder 149 on the left side of the valve body 147, tending to cause it to move to the right. At the same time, the increasing pressure in the line 52L causes the left function valve 140 to close off pressure to the piston cylinder 148 on the right side of the valve body. Consequently, about the same time the roller core 86 and covering 88 have moved to their full leftmost position on the shaft, the valve body 147 slides to the right (as partially shown by dotted line at the right) to pressurize the roller's right variable volume and vent the roller's left variable volume (just as in description of the operation illustrated in FIG. 6) to cause the roller core 86 and covering 88 to then return to the right and position shown in FIG. 6. Again, the subsequent rise in pressure in the left function valve 140 and the drop in pressure in the right function valve will again slide the valve body 147 to cause another stroke. This procedure is repeated for as long as desired to self oscillate the roller. It should be understood that any suitable roller biasing or centering arrangement, such as those described in conjunction with FIG. 6, could be adapted to the FIG. 7 self-oscillating control system.

Figure 3:
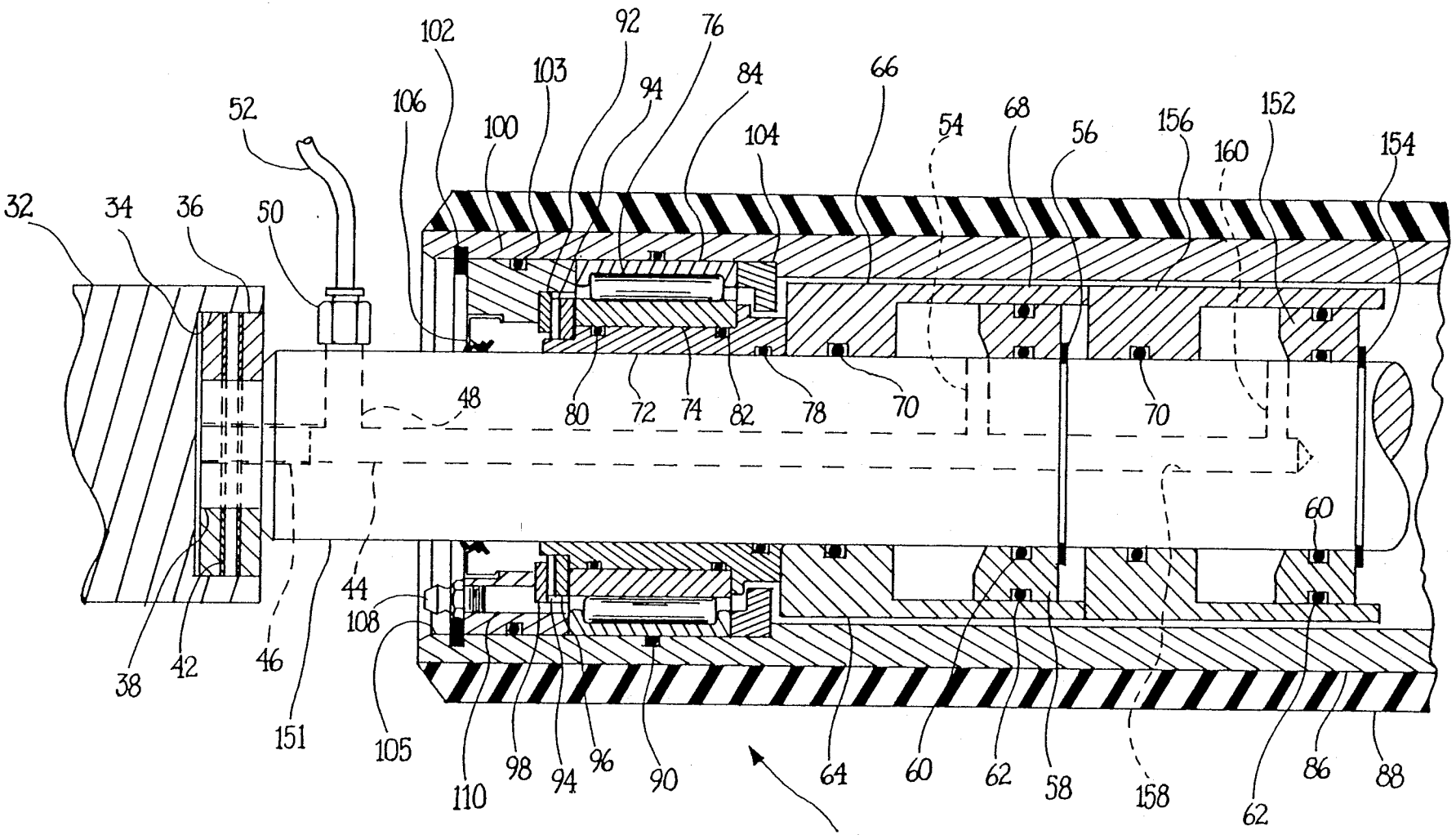
FIG. 3 is a cross-sectional view of an end of a second embodiment of an oscillating roller of the present invention, somewhat similar to that shown in FIG. 2, but different in that it features two stacked piston-cylinder structures instead of one.

Just as either control system is shown used with roller 30, either, depending upon application, could be used with the subsequently described embodiments of rollers of the present invention Referring to FIG. 3, a second embodiment roller 150 of the present invention is shown. This roller is generally similar to the roller shown in FIG. 2, and to the extent similar will be given the same references numerals as shown in FIG. 2. The principal difference between the roller shown in FIGS. 2 and 3, is that the roller 150 of FIG. 3 has a stacked piston and cylinder structure to develop additional axial force to oscillate the roller. As mentioned heretofore, this construction is particularly advantageous where the roller is of small diameter, and it is difficult to install a large cross-sectional area variable volume chamber to develop adequate force to oscillate the roller, particularly against the opposite direction axial oscillation of an adjacent roller.

As is shown, instead of having a single piston on each side of the roller shaft 151, a second identical inner piston 152 is provided on each side. This second piston cooperates with a second circle ring 154, provided in a second circle ring groove on the roller shaft 151, inward of the outer circle ring 56 and its groove. The second piston 152 is relatively slidable in a second, identical cylinder 156, inward of the first cylinder. Both the second piston 152 and second cylinder 156 have similar "O" rings as the first piston and first cylinder. The second cylinder 156 merely abuts the first cylinder 64. The air supply or vent for the second piston and cylinder is merely a continuation of the passage 44, being indicated by the numeral 158 and the radial passage 160 in communication therewith and with the second axial variable volume formed between the second cylinder 156 and the second piston 152.

The force generated in the second piston-cylinder is added to the force generated by the first piston-cylinder to double its force output. Of course, if additional force was required, additional piston-cylinder constructions could be stacked on each side of the roller.

Figure 4:
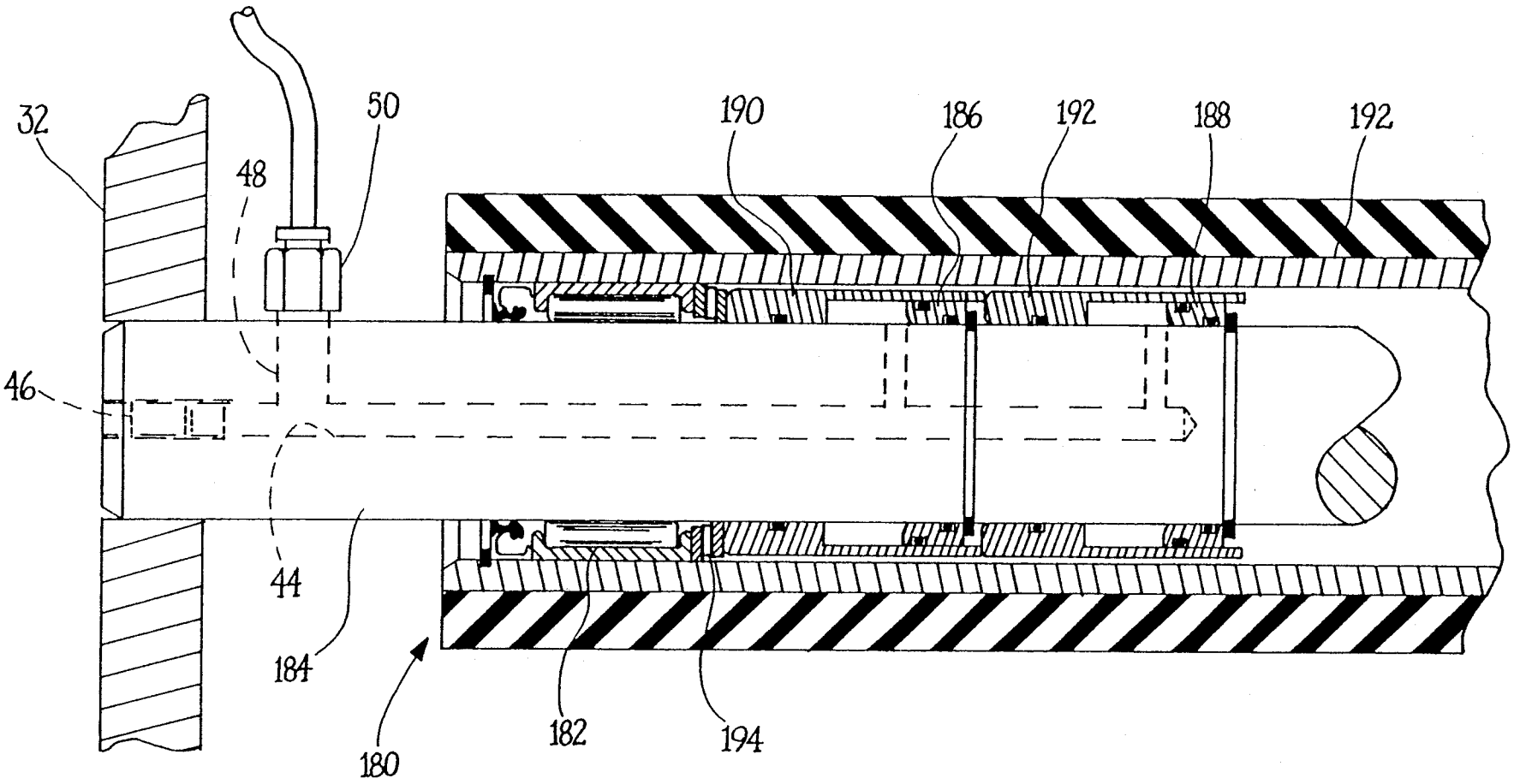
FIG. 4 is a cross-sectional view of an end of a third embodiment of an oscillating roller of the present invention, somewhat similar to that shown in FIG. 2, but different in that it is particularly suited for small diameter rollers.

Referring to FIG. 4, a third embodiment of oscillating roller 180 of the present invention is illustrated and described and is particularly suited for small diameter rollers. In this instance, instead of having the roller bearing rotate on an inner race carried on an inner annular sleeve, as shown in FIGS. 2 and 3, the roller 182 rotates directly on the roller shaft 184. The roller shaft could be hardened or heat treated in the area beneath the roller, if desired. The result is that the structure can be adapted to considerably smaller diameter rollers. As is shown, this type construction is used with the stacked piston-cylinder structure described above. That is two or more axial variable volumes are defined between two or more pistons 186 and 188 and cylinders 190 and 192 at each end of the roller to provide sufficient axial force. This construction is particularly suited for a small diameter roller (small area between the roller's core 192 and shaft 184).

Another difference between the third embodiment 180 and the earlier described embodiments, is the location of the thrust bearing. In the third embodiment the thrust bearing 194 is inside of the rollers 182, whereas before the thrust bearing was outside of the rollers 76. Either location is satisfactory and works well as long as the parts that rotate are separated from the parts that do not rotate by the thrust bearing.

Figure 8:
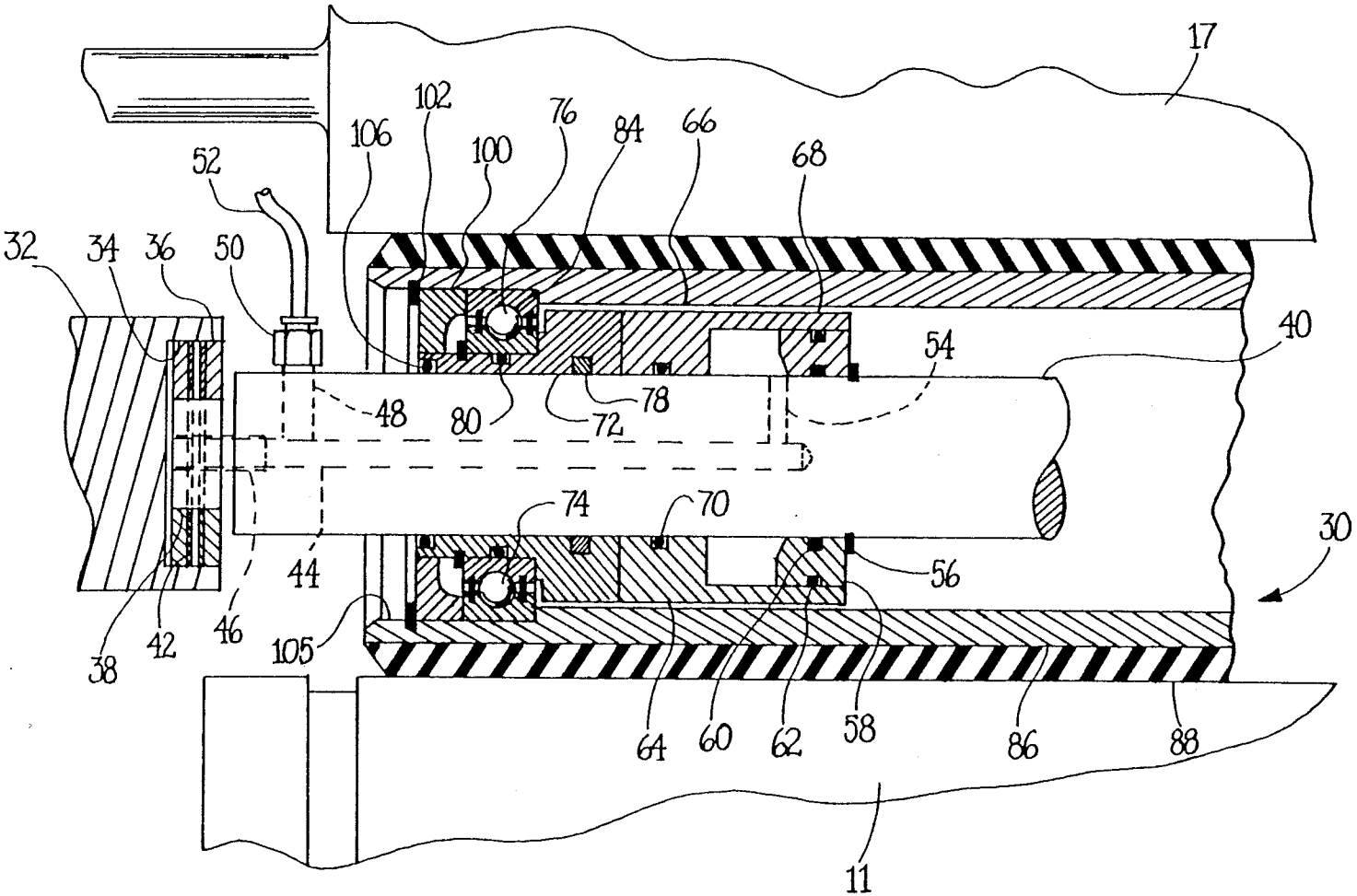
FIG. 8 is a schematic view of a fifth embodiment roller similar to that of FIG. 2, but using ball, instead of roller, bearings.

For any of the embodiments shown, it should be understood that the radial load carrying ability of the roller bearing and the axial load capability of the combination of the roller thrust bearing could be met in another manner, such as with taped roller bearings, angular contact ball bearings, or even plain ball bearings. However, the use of a roller bearing with a separate thrust bearing gives a great radial load capability with a more compact diameter. While roller or ball bearings are preferred, suitable sleeve bearings, such as of the oil impregnated type, could also be used. A ball bearing version of the roller bearing roller of FIG. 2 is shown in FIG. 8; the same reference numerals are used in FIG. 8 as in FIG. 2, except the numbers are shown as primes.

Figure 5:
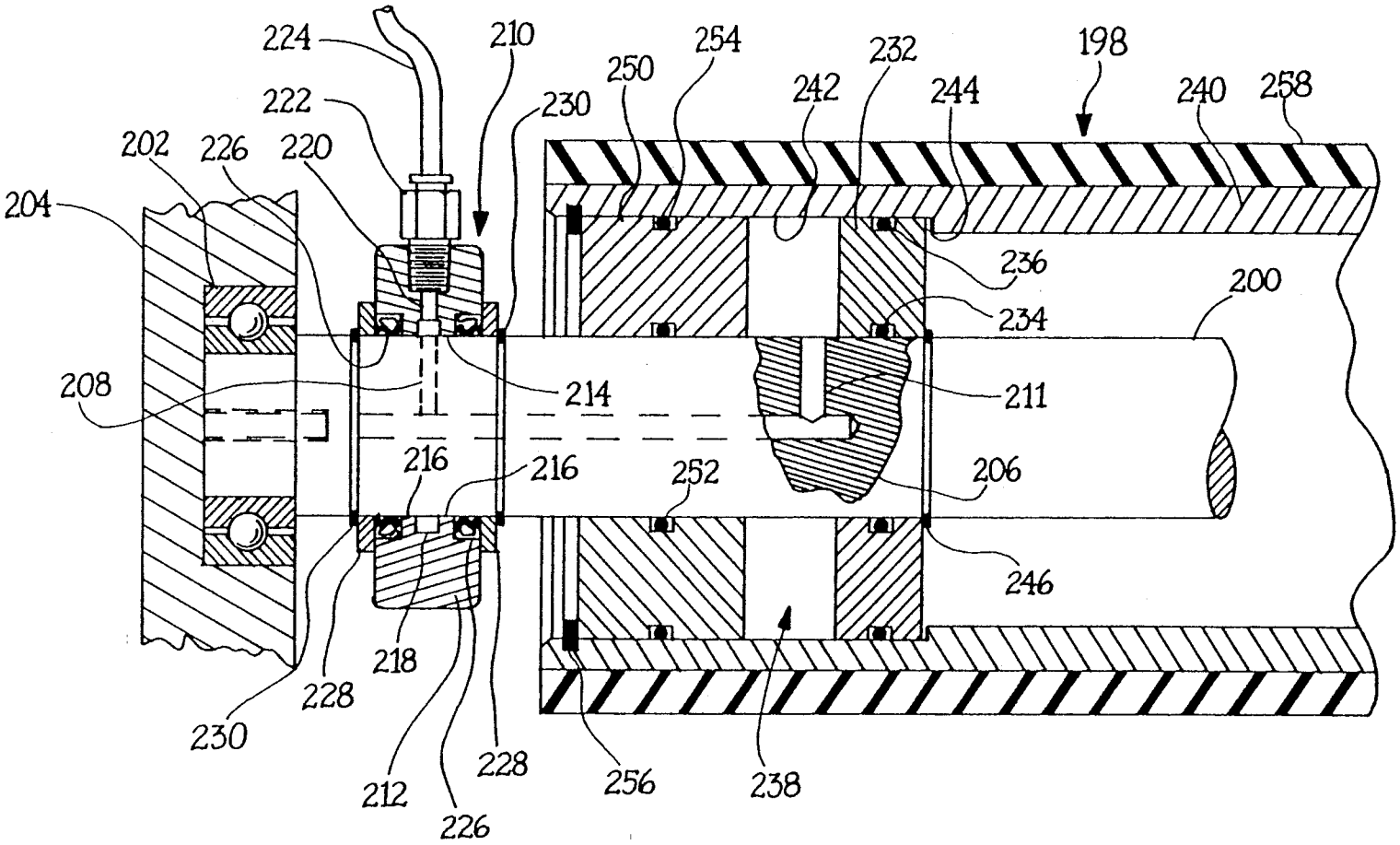
FIG. 5 is a cross-sectional view of a fourth embodiment of an oscillating roller of the present invention utilizing a live or rotating shaft.

Referring to FIG. 5, the fourth embodiment of axially oscillating roller 198 is shown. Unlike the prior described embodiments which had dead or non-rotating shafts, the fourth embodiment has a live or rotating shaft. As is shown, the shaft 200 is mounted by a pair of ball or roller bearings 202 held to the press hanger or frame 204. Thus, the entire shaft 200 is free to be rotated by an adjacent roller, be it a plate cylinder or other adjacent rotating roller. Of course, with this construction, the shaft 200 could be easily adapted to be mechanically rotated, as by a gear (not shown) on one end driven by the press drive.

As is shown, the roller shaft 200 has an air passage 206 therein which has a first radial connecting passage 208 leading from an air coupling 210 and a second radial passage 211 communicating with the variable volume piston and cylinder structure, which will be hereinafter described. The air coupling 210 itself is stationary and is capable of supplying air to or venting air from the rotating roller shaft 200 and its passage 208. As is shown, the coupling comprises a body 212 having an opening 214 to rotatably receive the shaft 200. As no separate bearing for the air coupling has been provided, the body 210, itself, can act as a bearing and may be made of a suitable bearing material, such as oil impregnated bronze. The body has two portions 216 which bearingly engage the shaft. Just inside the portions 216 an annular collector chamber 218 is formed in the body so as to always maintain communication with the rotating passage 208. The annular chamber 218, in turn, is connected via a passage 220 and fitting 222, to an air supply/vent line 224 from the control system. To reduce leakage, a pair of seals 226 are provided on the ends of the body which seal to the shaft 200. The seals 226 are held in place by two washer rings 228, which in turn are secured by two circle clips or rings 230 located in grooves on the shaft 200. Alternatively the seals 226 may be omitted and a close tolerance shaft bore can be provided in the air coupling body 210 to make the body function as an air bearing with a small flow of air escaping around the shaft 200 so that shaft's rotation is not restricted by air pressure on the seals. The body 210, itself, is prevented from rotation by the air line 224, and preferably by a torque strap (not shown) connecting the body 210 to the press frame.

As is shown, the second radial passage 211 is in communication with an axial variable volume at each end of the roller that cause the outer surface of the roller to axially oscillate. As is shown, and like the previously described embodiments, each axial variable volume chamber is provided by a piston and cylinder structure. The piston 232 is an annular member slidably fitting on the shaft 200. Again, no close fits are needed as the piston 232 has an inner "O" ring 234 and an outer "O" ring 236 to both seal the piston with the shaft 200 and cylinder 238, respectively. In this instance, the cylinder itself is formed by one end of the roller core 240, which is stepped as indicated at 242 to form a shoulder 244 to limit piston travel. Piston travel relative to the shaft in one direction, inwardly, is likewise limited by circle ring 246 engaged in a groove in the roller shaft 200. The other end of the annular, axial variable volume cylinder structure is closed by another annular ring 250 or cylinder head slidable on the roller shaft 200. The annular ring 250 is, likewise, sealed to both the shaft 200 and cylinder wall 238 by a pair of "O" rings, 252 and 254, respectively. While the annular ring 250 can slide on the roller shaft 200, the annular ring is prevented from moving further relatively outward of the roller core 240 as it abuts a circle ring 256 held in a groove formed in the outer end of the core 240.

The core 240, itself, is covered with a roller covering 258 suitable for the position in which the roller is to be operated. The use of the "O" rings 234 and 236 on member 232 and the the "O" rings 252 and 254 on the member 250 cause these two members and the shaft 200 to rotate with the core 240 and covering 258. Thus all relative rotation occurs in the bearings 202.

The foregoing structure is, preferably, duplicated on the other side of the roller and the two air supply/vent lines are connected to the control system in the manner such as shown in FIG. 6 or 7. This air under pressure may be supplied to the end shown in FIG. 5 to cause the variable volume on that side to axially expand, while air under pressure is being released or vented from the variable volume on the other end of the roller (not shown) so that the roller core 240 and its covering 258 oscillate or move left. At the desired moment the air connections are reversed so that the end shown in FIG. 5 is subsequently vented and the end not shown is pressurized to cause the core and covering to move to the right to complete a cycle. This operation is repeated and may be varied as has been described above.

In order to give some idea of the size of the rollers described, the roller shaft diameters could go from ¾ inch to 3 inch, the roller covering outside diameter could be from 2 inches to 8 inches. Of course, the smaller sizes are particularly applicable to the embodiment 180 shown in FIG. 4. While the construction of the present invention is particularly advantageous in rollers of lengths of 36 inches or greater, it could also be used in smaller rollers such as 12 inches in length or greater lengths such as 80 inches or more.

While the control systems are shown using a 4-way valve, two 3-way valves could be used instead. Likewise, given a suitable timing device, such as a multicontact relay or the like, a plurality of single solenoid valves could be used instead to perform the various functions.

While FIG. 1 illustrates a web press having a dampening and inking system wherein the ink and dampening fluids are provided to at least one common form roller, the present invention is applicable to any type dampening and/or inking system, such as those with more rolls in common, no rolls in common or even just an inking system. If course, the present invention could be incorporated in just one of the systems or both, or for just one, a few or many rollers on the web press. Ail of the foregoing, of course, should be considered as falling with the claims.

As is noted, the speed of oscillation of the roller is caused by pressurizing the variable volume at one end and venting the variable volume at the other end of the roller, and more particularly by being able to adjust the restriction in the vented line. This approach provides the advantage of a smoother operation and avoids jumpy type operation which are frequent where the speed is controlled merely by regulating the high pressure input.

While several preferred embodiments for an apparatus of an oscillating roller of the present invention and the method of oscillating a roller of the present invention have been illustrated and described, from the foregoing it should be understood that variations, modifications and equivalent structures and steps thereof fall within the scope of the appended claims.

What is claimed is:

1. An oscillating roller for one of the ink and dampening fluid systems of a printing press, comprising an elongated axially extending roller shaft having two opposed outer ends, means on said outer ends of said roller shaft for mounting said roller shaft to a printing press, a plurality of annular cylinder heads located on and concentric with said roller shaft, said annular cylinder heads being axially spaced apart along said roller shaft, at least one of said annular cylinder heads being located adjacent each of said outer ends of said roller shaft, a plurality of separate annular pistons relatively non-rotatably mounted and relatively slidable on and concentric with said roller shaft, said plurality of separate annular pistons being axially spaced apart along said roller shaft, at least one of said separate annular pistons being located adjacent each of said outer ends of said roller shaft, a plurality of annular cylinder walls axially spaced apart along said roller shaft between said annular cylinder heads and said separate annular pistons, each of said separate annular pistons sliding in the adjacent said annular cylinder wall, said roller shaft extending through each of said pluralities of annular cylinder heads, separate annular pistons and annular cylinder walls, said pluralities of annular cylinder heads, separate annular pistons and annular cylinder walls cooperating to form a plurality of annular axially variable volumes about said roller shaft, at least one of said annular axially variable volumes being located adjacent each of said outer ends of said roller shaft, control means for admitting and exiting pressurized fluid from said plurality of annular axially variable volumes for causing axial oscillating motion of said plurality of separate annular pistons relative to said plurality of annular cylinder heads, a hollow roller core, said outer ends of said roller shaft extending beyond said hollow roller core, said pluralities of separate annular pistons, annular cylinder heads and annular cylinder walls being contained beneath said hollow roller core, said hollow roller core being spaced radially outwardly apart from each of said plurality of annular cylinder walls, and means for axially moving said hollow roller core with one of said plurality of annular cylinder walls and plurality of separate annular pistons, whereby operating said control means to admit and exit pressurized fluid from said plurality of annular axial variable volumes causes axial oscillating motion of said hollow roller core relative to said roller shaft.

2. An oscillating roller as in claim 1, wherein said roller shaft is a dead shaft, and said means on said outer ends of said roller shaft for mounting said roller shaft includes means for non-rotatably securing said roller shaft to the printing press, and said means for axially moving said hollow roller core rotatably and slidably mounts said hollow roller core to said roller shaft.

3. An oscillating roller as in claim 2, wherein said oscillating roller has at least four of said separate annular pistons, at least four of said annular cylinder walls and at least four of said annular cylinder heads forming at least four of said annular axially variable volumes, two of said annular axial variable volumes being located adjacent each of said outer ends of said roller shaft.

4. An oscillating roller as in claim 1, wherein said oscillating roller has two of said separate annular pistons, two of said annular cylinder walls and two of said annular cylinder heads forming two of said annular axially variable volumes, one of said annular axially variable volumes being adjacent each of said outer ends of said roller shaft.

5. An oscillating roller as in claim 1, wherein said oscillating roller has a plurality of said separate annular pistons, a plurality of said annular cylinder heads and a plurality of annular cylinder walls adjacent each of said outer ends of said oscillating roller to provide a plurality of annular axial variable volumes adjacent each of the ends of said oscillating roller, and said control means comprises means for alternately pressurizing and venting said plurality of annular axially variable volumes adjacent each of said ends of said oscillating roller to oscillate said oscillating roller.

6. An oscillating roller as in claim 1, wherein said means for axially moving said hollow roller core further comprises bearing means to rotatable mount said hollow roller core, said bearing means having an inner portion slidable on said roller shaft and axially movable by said annular axially variable volumes.

7. An oscillating roller as in claim 6, wherein said bearing means comprises bearings capable of taking radial and axial loads on said hollow roller core.

8. An oscillating roller as in claim 6, wherein said bearings means are roller bearings.

9. An oscillating roller as in claim 6, wherein said bearing means are ball bearings.

10. An oscillating roller as in claim 1, wherein said plurality of separate annular pistons, said plurality of annular cylinder heads, said plurality of annular cylinder walls, and said plurality of annular axially variable volumes are each even in number.

11. An oscillating roller as in claim 1, wherein said oscillating roller has a plurality of said separate annular pistons, a plurality of said annular cylinder heads and a plurality of annular cylinder walls adjacent each of said outer ends of said oscillating roller to provide a plurality of annular axial variable volumes adjacent each of said outer ends of said oscillating roller, said control means comprises means for alternately pressurizing and venting said plurality of annular axially variable volumes adjacent each of said outer ends of said roller shaft to oscillate said oscillating roller, said means for axially moving said hollow roller core further comprising bearing means to rotatable mount said hollow roller core, said bearing means having an inner portion slidable on said roller shaft and axially movable by said annular axially variable volumes, said bearing means being capable of taking radial and axial loads on said hollow roller core and being one of roller and ball bearings.

12. An oscillating roller as in claim 1, wherein said plurality of annular cylinder heads, said plurality of separate annular pistons and said plurality of annular cylinder walls are stackable on said roller shaft to form said plurality of annular axially variable volumes, whereby the force required to oscillate the oscillating roller may be increased by stacking said annular axially variable volumes on said roller shaft.

13. An oscillating roller as in claim 1, wherein each of said annular cylinder heads is integrally formed with its cooperating adjacent said annular cylinder wall, each of said separate annular pistons being slidable in its cooperating adjacent said annular cylinder walls, said annular cylinder heads, said annular cylinder walls and said separate annular pistons being stackable on said roller shaft.

14. An oscillating roller for one of the ink and dampening fluid systems of a printing press, comprising an elongated axially extending roller shaft having two opposed outer ends, means on said outer ends of said roller shaft for rotatably mounting said roller shaft to a printing press, a plurality of annular cylinder heads located on and concentric with said roller shaft, said annular cylinder heads being axially spaced apart along said roller shaft, at least one of said annular cylinder heads being located adjacent each of said outer ends of said roller shaft, a plurality of separate annular pistons relatively non-rotatably mounted and relatively slidable on and concentric with said roller shaft, said plurality of separate annular pistons being axially spaced apart along said roller shaft, at least one of said separate annular pistons being located adjacent each of said outer ends of said roller shaft, a plurality of cylinder walls axially spaced apart along said roller shaft between said annular cylinder heads and said separate annular pistons, each of said separate annular pistons sliding in the adjacent said cylinder wall, said roller shaft extending through each of said pluralities of annular cylinder heads, separate annular pistons and cylinder walls, said pluralities of annular cylinder heads, separate annular pistons and cylinder walls cooperating to form a plurality of annular axially variable volumes about said roller shaft, at least one of said annular axially variable volumes being located adjacent each of said outer ends of said roller shaft, control means for admitting and exiting pressurized fluid from said plurality of annular axially variable volumes for causing axial oscillating motion of said plurality of separate annular pistons relative to said plurality of annular cylinder heads, and a hollow roller core, said outer ends of said roller shaft extending beyond said hollow roller core, said pluralities of separate annular pistons, annular cylinder heads and cylinder walls being contained beneath said hollow roller core, said hollow roller core on its interior forming each of said plurality of cylinder walls, whereby operating said control means to admit and exit pressurized fluid from said plurality of annular axial variable volumes causes axial oscillating motion of said hollow roller core relative to said roller shaft.

15. An oscillating roller as in claim 14, wherein said roller shaft is a live shaft, and said means on said outer ends of said roller shaft for rotatably mounting said roller shaft includes bearing means for rotatably securing said roller shaft to the printing press.

16. An oscillating roller as in claim 15, wherein said oscillating roller has at least four of said separate annular pistons, at least four of said cylinder walls and at least four of said annular cylinder heads forming at least four of said annular axially variable volumes, two of said annular axial variable volumes being located adjacent each of said outer ends of said roller shaft.

17. An oscillating roller as in claim 14, wherein said oscillating roller has two of said separate annular pistons, two of said cylinder walls and two of said annular cylinder heads forming two of said annular axially variable volumes, one of said annular axially variable volumes being adjacent each of said outer ends of said roller shaft.

18. An oscillating roller as in claim 14, wherein said oscillating roller has a plurality of said separate annular pistons, a plurality of said annular cylinder heads and a plurality of cylinder walls adjacent each of said outer ends of said oscillating roller to provide a plurality of annular axial variable volumes adjacent each of the ends of said oscillating roller, and said control means comprises means for alternately pressurizing and venting said plurality of annular axially variable volumes adjacent each of said ends of said oscillating roller to oscillate said oscillating roller.

19. An oscillating roller as in claim 15, wherein said bearing means comprises bearings capable of taking radial and axial loads.

20. An oscillating roller as in claim 15, wherein said bearings means are roller bearings.

21. An oscillating roller as in claim 15, wherein said bearing means are ball bearings.

22. An oscillating roller as in claim 14, wherein said plurality of separate annular pistons, said plurality of annular cylinder heads, said plurality of cylinder walls, and said plurality of annular axially variable volumes are each even in number.

23. An oscillating roller as in claim 14, wherein said oscillating roller has a plurality of said separate annular pistons, a plurality of said annular cylinder heads and a plurality of cylinder walls adjacent each of said outer ends of said oscillating roller to provide a plurality of annular axial variable volumes adjacent each of said outer ends of said oscillating roller, said control means comprises means for alternately pressurizing and venting said plurality of annular axially variable volumes adjacent each of said outer ends of said roller shaft to oscillate said oscillating roller, said means on said outer ends comprising bearing means to rotatable mount said roller shaft, said bearing means being capable of taking radial loads on said roller shaft and being one of roller and ball bearings.

24. An oscillating roller as in claim 14, wherein said plurality of annular cylinder heads, said plurality of separate annular pistons and said plurality of cylinder walls are stackable on said roller shaft to form said plurality of annular axially variable volumes, whereby the force required to oscillate the oscillating roller may be increased by stacking additional said annular axially variable volumes on said roller shaft.

25. An oscillating roller for one of the ink and dampening fluid systems of a printing press, comprising an elongated axially extending roller shaft having two opposed outer ends, means on said outer ends of said roller shaft for mounting said roller shaft to a printing press, a plurality of annular cylinder heads located on and concentric with said roller shaft, said annular cylinder heads being axially spaced apart along said roller shaft, at least one of said annular cylinder heads being located adjacent each of said outer ends of said roller shaft, a plurality of separate annular pistons relatively non-rotatably mounted and relatively slidable on and concentric with said roller shaft, said plurality of separate annular pistons being axially spaced apart along said roller shaft, at least one of said separate annular pistons being located adjacent each of said outer ends of said roller shaft, a plurality of cylinder walls axially spaced apart along said roller shaft between said annular cylinder heads and said separate annular pistons, each of said separate annular pistons sliding in the adjacent said cylinder wall, said roller shaft extending through each of said pluralities of annular cylinder heads, separate annular pistons and cylinder walls, said pluralities of annular cylinder heads, separate annular pistons and cylinder walls cooperating to form a plurality of annular axially variable volumes about said roller shaft, at least one of said annular axially variable volumes being located adjacent each of said outer ends of said roller shaft, said plurality of annular cylinder heads, said plurality of separate annular pistons and said plurality of annular cylinder walls being stackable on said roller shaft to form said plurality of annular axially variable volumes, control means for admitting and exiting pressurized fluid from said plurality of annular axially variable volumes for causing axial oscillating motion of said plurality of separate annular pistons relative to said plurality of annular cylinder heads, and a hollow roller core, said outer ends of said roller shaft extending outwardly beyond said hollow roller core, said pluralities of separate annular pistons, annular cylinder heads and cylinder walls being contained beneath said hollow roller core, whereby the force required to oscillate the oscillating roller may be increased by stacking said annular axially variable volumes on said roller shaft, and operating said control means to admit and exit pressurized fluid from said plurality of annular axial variable volumes causes axial oscillating motion of said hollow roller core relative to said roller shaft.

* * * * *